US010072473B2

(12) United States Patent
Rud

(10) Patent No.: US 10,072,473 B2
(45) Date of Patent: Sep. 11, 2018

(54) CONFORMING MAGNET TOOL FOR RECOVERY OF DOWNHOLE DEBRIS

(71) Applicant: Baker Hughes Incorporated, Houston, TX (US)

(72) Inventor: Ellen Ellis Rud, Houston, TX (US)

(73) Assignee: BAKER HUGHES, A GE COMPANY, LLC

( * ) Notice: Subject to any disclaimer, the term of this patent is extended or adjusted under 35 U.S.C. 154(b) by 214 days.

(21) Appl. No.: 15/200,889

(22) Filed: Jul. 1, 2016

(65) Prior Publication Data

US 2018/0003006 A1 Jan. 4, 2018

(51) Int. Cl.
*E21B 31/06* (2006.01)
*E21B 37/00* (2006.01)

(52) U.S. Cl.
CPC ..... *E21B 31/06* (2013.01); *E21B 37/00* (2013.01)

(58) Field of Classification Search
CPC ..... E21B 37/00; E21B 27/00; E21B 27/005; E21B 31/06; E21B 31/12; B08B 9/0433; B08B 9/0495
See application file for complete search history.

(56) References Cited

U.S. PATENT DOCUMENTS 2,657,752 A * 11/1953 Ballew ..... E21B 31/06 166/66.5
2,734,767 A * 2/1956 Donham ..... E21B 31/06 166/66.5
2,778,669 A * 1/1957 Goodwin ..... E21B 31/06 166/66.5
3,203,491 A * 8/1965 Turley ..... E21B 31/06 166/66.5
3,441,307 A * 4/1969 Farmer ..... E21B 31/06 166/99
3,520,359 A * 7/1970 Ehrlich ..... E21B 31/06 166/66.5
3,905,631 A * 9/1975 Ricks ..... E21B 31/06 294/65.5
4,488,747 A * 12/1984 Austin ..... E21B 31/007 294/86.1
4,654,989 A 4/1987 Fleming
5,622,090 A 4/1997 Marks
D385,762 S 11/1997 Marks
5,791,209 A 8/1998 Marks
6,085,619 A 7/2000 Blake et al.
7,357,183 B2 * 4/2008 Gazewood ..... E21B 31/06 166/301
7,753,124 B1 * 7/2010 Penisson ..... E21B 27/00 166/311
8,678,091 B2 * 3/2014 Nelson ..... E21B 17/1078 166/311
2017/0044874 A1 * 2/2017 Nicol ..... E21B 41/00

OTHER PUBLICATIONS

Gator-Grip, Print out of website www.gator-grip.eu/ as of Oct. 25, 2015 (retrieved on Jun. 29, 2017 via web.archive.org), 3 pages.

* cited by examiner

*Primary Examiner* — Michael R Wills, III
(74) *Attorney, Agent, or Firm* — Shawn Hunter

(57) ABSTRACT

A debris removal tool for removal of metallic debris from within a wellbore. The debris removal tool includes a housing defining a central bore and a plurality of magnetic members retained within the central bore and axially moveable therewithin, the magnetic members each presenting a contact surface to contact and form a magnetic attachment to the metallic debris.

18 Claims, 6 Drawing Sheets

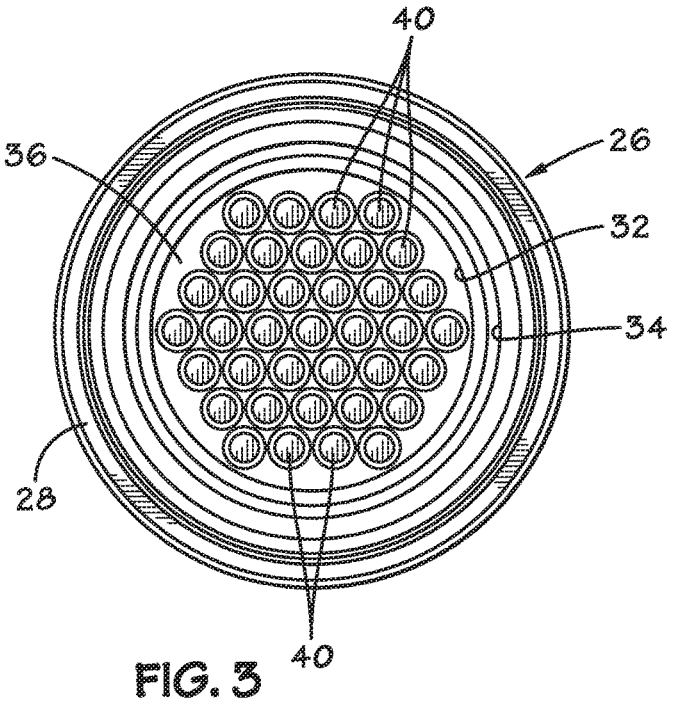
FIG. 3
FIG. 4
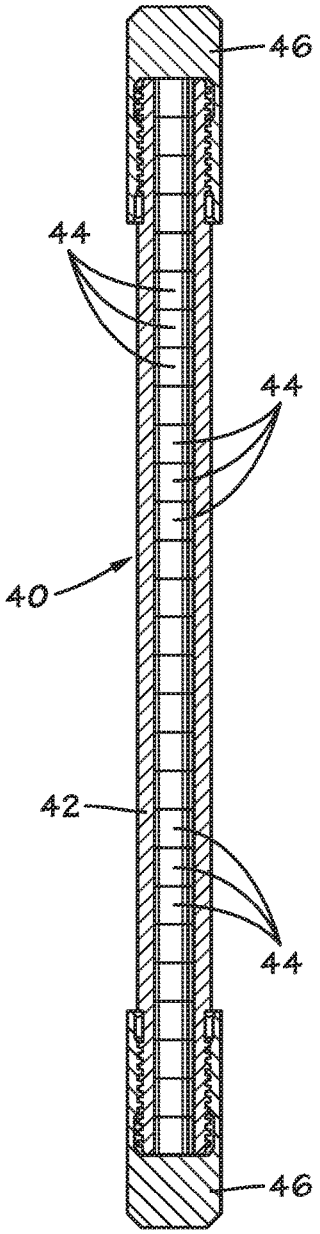

CONFORMING MAGNET TOOL FOR RECOVERY OF DOWNHOLE DEBRIS

BACKGROUND OF THE INVENTION

1. Field of the Invention

The invention relates generally to magnetic tools useful for removal of metallic debris from a wellbore.

2. Description of the Related Art

During hydrocarbon production operations, metallic debris is often generated by perforating or sidetracking operations. If objects are removed from the wellbore by milling, metallic debris will end up within the wellbore. It is important to remove such debris to improve production quality.

SUMMARY OF THE INVENTION

The invention provides tools and methods for removal of metallic debris, including cuttings, shavings, and other objects which accumulate in a wellbore as a result of wellbore operations. An exemplary debris removal tool assembly is described which includes a running string with a debris removal tool at its distal end.

The described debris removal tool includes a cylindrical housing which defines an interior bore with a magnetic member retaining portion which extends into the bore from the housing. A plurality of magnetic members are retained within openings of the magnetic member retaining portion. Each of the magnetic members is axially moveable within their openings. The magnetic members may also be moveable diagonally or at an angle with respect to the axis of the debris removal tool. In some embodiments, the magnetic members are elongated tubes which contain a plurality of individual magnets. End caps secure the magnets within the tubes. In other embodiments, the magnetic members are electromagnets which are provided electrical power from an external source.

In operation, the debris removal tool assembly is disposed into a wellbore and lowered until the debris removal tool is brought into contact with downhole debris. Debris is received within the lower portion of the interior bore and contacts the distal ends of the magnetic members. Set down weight is applied to cause the magnetic members to conform to the shape of the debris and thereby provide maximal magnetic force for debris pick up. Debris is removed as the debris removal tool assembly is withdrawn from the wellbore.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein:

FIG. 3 is an axial end view of the debris removal tool on FIG. 2 taken from the lower end of the tool.

FIG. 4 is an enlarged cross-sectional side view of an exemplary magnet tube constructed in accordance with the present invention.

DETAILED DESCRIPTION OF THE PREFERRED EMBODIMENTS

Figure 1:
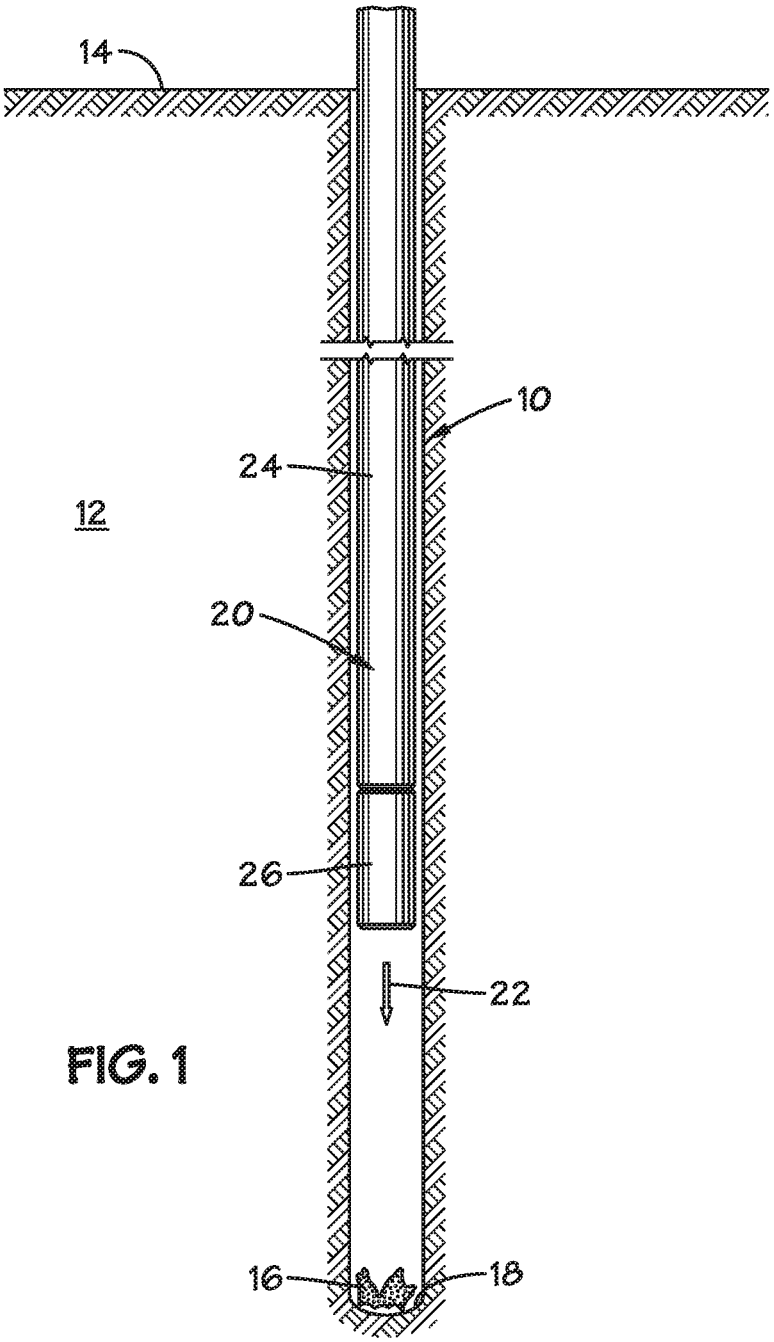
FIG. 1 is a side, cross-sectional view of an exemplary wellbore containing debris and a debris removal tool assembly constructed in accordance with the present invention.

FIG. 1 depicts a wellbore 10 which has been drilled through the earth 12 from the surface 14. Although the wellbore 10 is depicted as a substantially vertical wellbore, it may be deviated or have deviated portions. The wellbore 10 contains metallic debris 16 at its lower end 18.

A debris removal tool assembly 20 is shown being run in to the wellbore 10 in the direction of arrow 22. The debris removal tool assembly 20 includes a running string 24. The running string 24 can be coiled tubing or a string of conventional oilfield tubular members which are interconnected in an end-to-end fashion.

Figure 2:
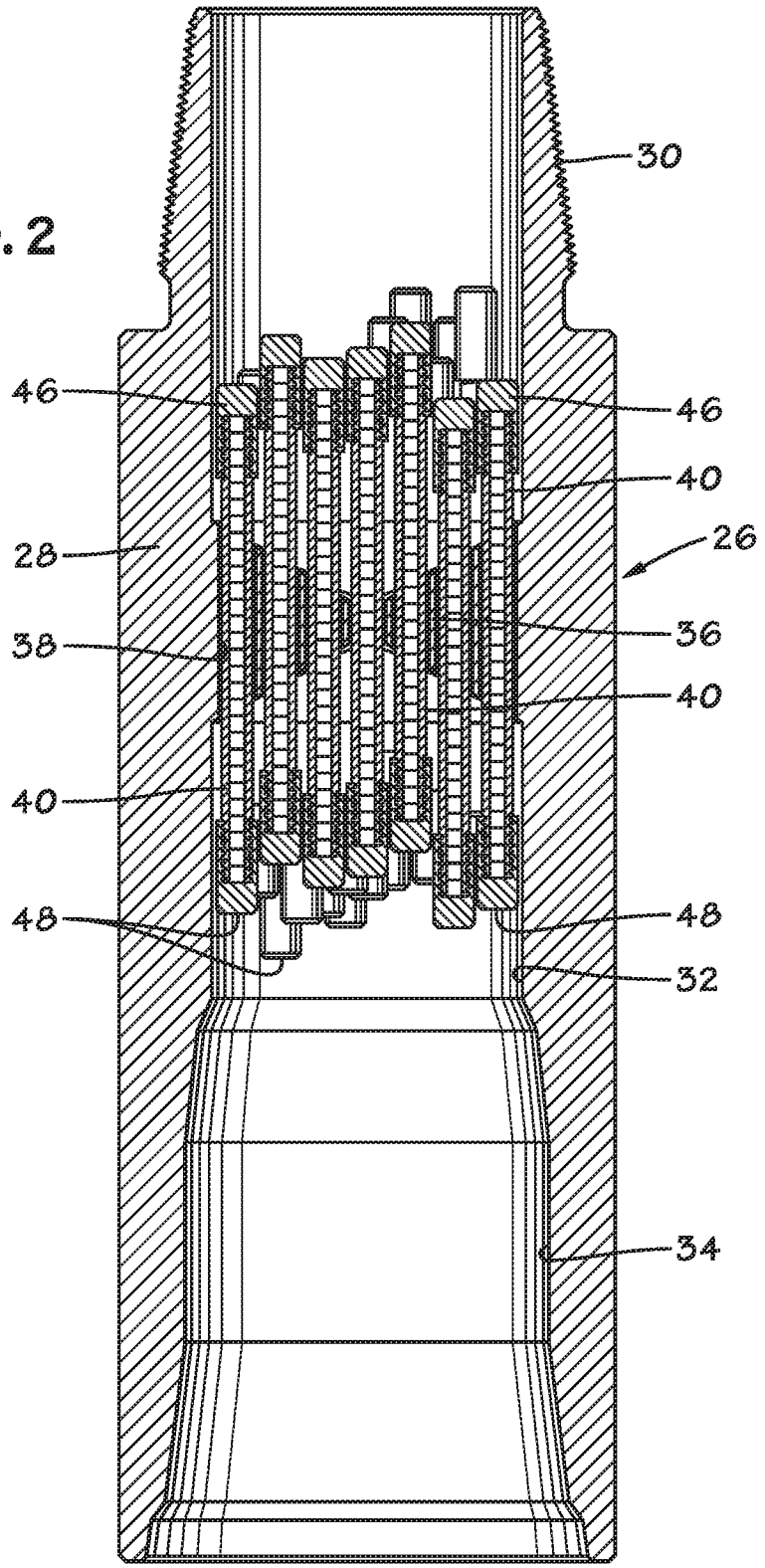
FIG. 2 is a side, cross-sectional view of a debris removal tool which is incorporated into the debris removal tool assembly of FIG. 1.

A debris removal tool 26 is affixed to the distal end of the running string 24. An exemplary debris removal tool 26 is illustrated in greater detail in FIGS. 2-3. The depicted debris removal tool 26 includes a generally cylindrical housing 28. Preferably, the housing 28 has a threaded end portion 30 which is used to secure the debris removal tool 26 to the running string 24. It is noted, however, that other types of connectors may be used in place of threading. For example, the housing 28 may be configured to be connected using a snap ring, dowel pin, welding, or in other ways known in the art. A central bore 32 is defined within the housing 28. Preferably, the central bore 32 has a radially enlarged lower end 34.

A magnetic member retaining portion 36 is formed within the central bore 32 of the housing 28. The magnetic member retaining portion 36 extends radially inwardly from the surrounding housing 24 into the central bore 32 and provides mechanical support for loosely retaining a plurality of magnetic members within the central bore 32. The magnetic member retaining portion 36 may be integrally formed with the surrounding housing 24, as shown. Alternatively, the magnetic member retaining portion 36 can be a separate component, such as a plate which is secured within the central bore 32. Openings 38 are formed within the magnetic member retaining portion 36. There are preferably a plurality of openings 38, the number and pattern of which may be varied depending upon tube geometry and size as well as the size of the surrounding housing 28.

An elongated magnetic member 40 is retained within each of the openings 38 and each is axially moveable with respect to the housing 28. The magnetic members 40 can individually slide axially within their openings 38. As best shown in FIG. 4, the magnetic members 40 are each preferably tubes 42 which contain a plurality of magnets 44. The tubes 42 may be made of steel or another metal. However, the tubes 42 could also be made of other materials having suitable strength in compression and tension to be set down upon and retrieve metallic debris 16. The magnets 44 are preferably permanent, rare earth magnets, especially neodymium or samarium cobalt, which are ideal for their high strength. End caps 46 are threaded onto the axial ends of each tube 42 to secure the magnets 44 within. It is noted that, alternatively, the magnetic members 40 could be a single rod-shaped magnet machined to have threads on its axial ends to which end caps 46 could be affixed.

Figure 7:
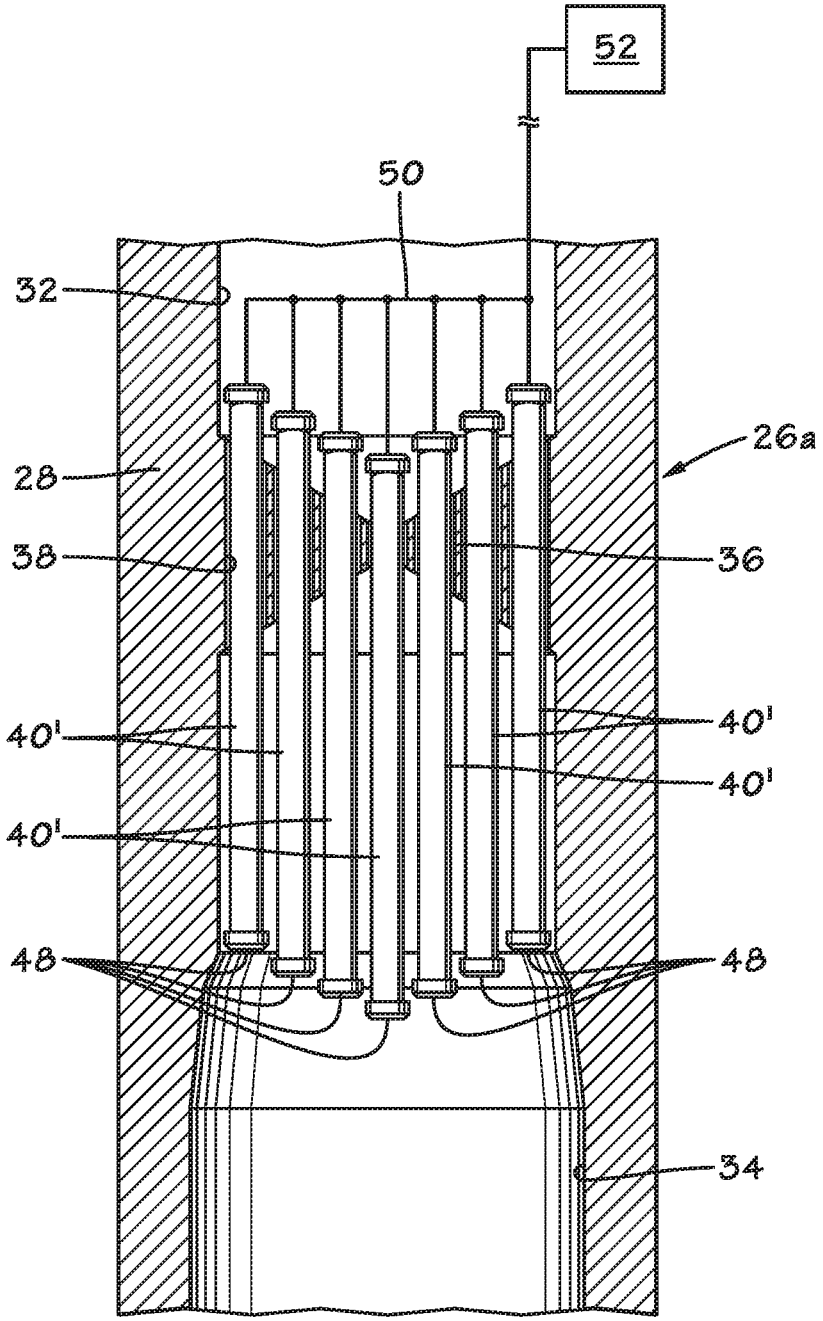
FIG. 7 is a side, cross-sectional view illustrating an embodiment of a debris removal tool which incorporates electromagnets.

In alternative embodiments, the magnetic members 40 are electromagnets. The electromagnets would have to be provided with external electrical power to energize the magnets. FIG. 7 illustrates an alternative embodiment for a debris removal tool 26*a* wherein the magnetic members 40' are electromagnets which can be selectively energized by an external electrical power source. Power conductors 50 extend from each magnetic member 40' to an electrical power source 52. The power source 52 is preferably a direct current electrical power source which may be located either at surface 14 or within the wellbore 10. The power source 52 is provided with a switch (not shown) wherein it can selectively energize the magnetic members 40' in order create a magnetic attachment between the magnetic members 40' and the debris 16.

Figure 5:
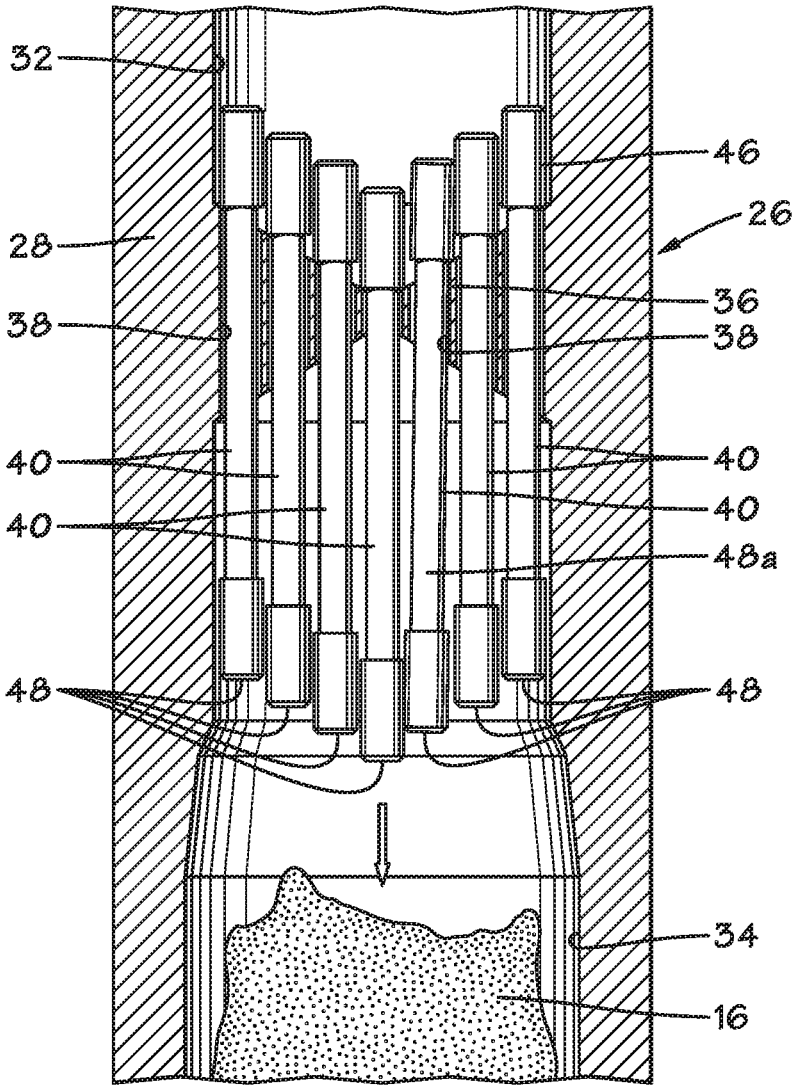
FIG. 5 is a side, cross-sectional view of a portion of the debris removal tool as it approaches debris to be removed from the wellbore.

In particular embodiments, the magnetic members 40 are also preferably moveable in an angular manner with respect to the axis of the debris removal tool 26. A slight angular or diagonal departure during movement is illustrates by magnetic member 48*a* in FIG. 5. By according a loose fit between the magnetic members 40 and their surrounding openings 38, this angular or diagonal movement allows for improved conformance of the magnetic members 40 to the contour of the debris 16.

Figure 6:
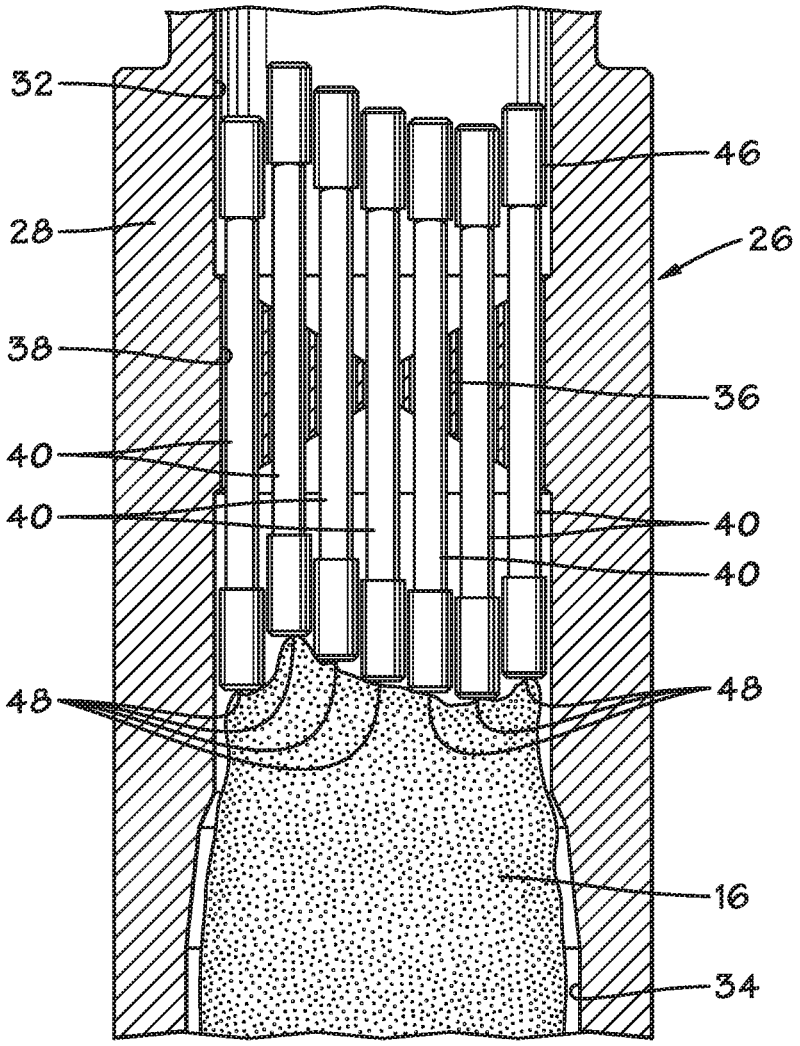
FIG. 6 is a side, cross-sectional view of the debris removal tool portion shown in FIG. 5, now with the magnetic members in contact with the debris.

The present invention also provides methods for removing metallic debris from a wellbore. First, the debris removal tool assembly 20 is run into the wellbore 10 and moved proximate metallic debris 16 to be removed. The radially enlarged lower end 34 of the housing 28 is moved around and over the debris 16. As the debris removal tool 26 is moved proximate the debris 16, the metallic debris 16 will attract the magnetic members 40 to cause them to move axially downwardly along with the force of gravity (see FIG. 5). The magnetic members 40 present a contact surface 48 at their lower end which will contact the debris 16 and form a magnetic attachment with it. Depending upon the shape of the debris 16, some of the plurality of magnetic members 40 might not form a magnetic attachment with the debris 16. However, as the magnetic members 40 make contact with the debris 16, they will slide axially within the retaining plate 36 to conform to the shape of the debris 16 as illustrated in FIG. 6, thereby providing a number of separate attachments points with the debris 16. The magnetic members 40 thereby conform to the shape of the debris 16 in order to form a better magnetic bond with the debris 16. The debris 16 is removed from the wellbore 10 as the debris removal tool assembly 20 is withdrawn from the wellbore 10.

Those of skill in the art will recognize that numerous modifications and changes may be made to the exemplary designs and embodiments described herein and that the invention is limited only by the claims that follow and any equivalents thereof.

What is claimed is:

1. A debris removal tool for use in removing metallic debris from a wellbore, the debris removal tool comprising:
- a housing defining a central bore; and
- a plurality of magnetic members retained within the central bore and axially moveable with respect to the housing while retained within the central bore, the magnetic members each presenting a contact surface to contact and form a magnetic attachment to the metallic debris.

2. The debris removal tool of claim 1 wherein at least one of the magnetic members comprises an elongated tube containing a plurality of magnets.

3. The debris removal tool of claim 1 wherein the plurality of magnetic members is retained within the central bore by a magnetic member retaining portion having openings within which each of the magnetic members is retained.

4. The debris removal tool of claim 1 wherein the central bore further comprises a radially enlarged portion into which the metallic debris is received.

5. The debris removal tool of claim 1 wherein at least one of the magnetic members comprises an electromagnet.

6. The debris removal tool of claim 1 wherein movement of the magnetic members with respect to the housing allows the magnetic members to conform to a shape of the metallic debris to provide increased magnetic force for debris pickup.

7. The debris removal tool of claim 1 wherein the magnetic members are further moveable in an angular manner with respect to an axis of the debris removal tool.

8. A debris removal tool assembly for use in removing metallic debris from a wellbore, the debris removal tool assembly comprising:
- a running string that is run into the wellbore from surface, the running string having a distal end;
- a debris removal tool affixed to the distal end of the running string, the debris removal tool having:
  - a housing defining a central bore; and
  - a plurality of magnetic members retained within the central bore and axially moveable with respect to the housing while retained within the central bore, the magnetic members each presenting a contact surface to contact and form a magnetic attachment to the metallic debris.

9. The debris removal tool assembly of claim 8 wherein at least one of the magnetic members comprises an elongated tube containing a plurality of magnets.

10. The debris removal tool assembly of claim 9 wherein the central bore further comprises a radially enlarged portion into which the metallic debris is received.

11. The debris removal tool assembly of claim 8 wherein the plurality of magnetic members is retained within the central bore by a magnetic member retaining portion having openings within which each of the magnetic members is retained.

12. The debris removal tool of claim 8 wherein at least one of the magnetic members comprises an electromagnet.

13. The debris removal tool assembly of claim 8 wherein movement of the magnetic members with respect to the housing allows the magnetic members to conform to a shape of the metallic debris to provide increased magnetic force for debris pickup.

14. The debris removal tool assembly of claim 8 wherein the magnetic members are further moveable in an angular manner with respect to an axis of the debris removal tool.

15. A method for removing metallic debris from a wellbore, the method comprising the steps of:
- disposing a debris removal tool assembly into the wellbore, the debris removal tool assembly having a housing defining a central bore and a plurality of magnetic members retained within the central bore and axially moveable with respect to the housing while retained within the central bore, the magnetic members each presenting a contact surface to contact and form a magnetic attachment to the metallic debris;

contacting the metallic debris with contact surfaces of at least some of the magnetic members to form a magnetic attraction therewith; and removing the debris removal tool assembly and metallic debris from the wellbore.

16. The method of claim 15 wherein:

the central bore of the housing presents a radially enlarged portion; and the metallic debris is received into the radially enlarged portion before the magnetic attachment is formed.

17. The method of claim 15 wherein the step of contacting the metallic debris with contact surfaces of at least some of the magnetic members to form a magnetic attraction therewith further comprises allowing the magnetic members to conform to a shape of the metallic debris to provide increased magnetic force for debris pickup.

18. The method of claim 15 wherein the magnetic members are further moveable in an angular manner with respect to an axis of the debris removal tool.

* * * * *